US005911546A

United States Patent [19]

Vales

[11] Patent Number: 5,911,546

[45] **Date of Patent: *Jun. 15, 1999**

[54] IN-GROUND BARRIER

[75] Inventor: Enoch Sam Vales, Kitchener, Canada

[73] Assignee: University of Waterloo, Waterloo, Canada

[ * ] Notice: This patent is subject to a terminal disclaimer.

[21] Appl. No.: 08/734,581

[22] Filed: Oct. 17, 1996

Related U.S. Application Data

[62] Division of application No. 07/765,254, Sep. 25, 1991, abandoned, which is a continuation of application No. 07/487,260, Mar. 2, 1990, abandoned.

[30] Foreign Application Priority Data

Mar. 3, 1989 [GB] United Kingdom ..... 89/04845

[51] Int. Cl.[6] ..... E02D 5/06; E02D 5/08; E02D 5/14

[52] U.S. Cl. ..... 405/279; 405/276; 405/278

[58] Field of Search ..... 405/108, 128, 405/129, 274–281

[56] References Cited

U.S. PATENT DOCUMENTS

| | | | |
|---|---|---|---|
| 697,943 | 4/1902 | Jackson . | |
| 824,513 | 6/1906 | Stevens | 405/279 |
| 826,801 | 7/1906 | Quimby, Jr. | 405/279 |
| 836,725 | 11/1906 | Williams | 405/281 |
| 838,152 | 12/1906 | Williams | 405/281 |
| 879,792 | 2/1908 | Nye | 405/279 X |
| 912,021 | 2/1909 | Neilson | 405/278 |
| 930,487 | 8/1909 | Marsh | 405/279 |
| 993,779 | 5/1911 | Johnston | 405/276 |
| 1,007,718 | 11/1911 | McGill . | |
| 1,175,168 | 3/1916 | Moulton . | |
| 1,176,294 | 3/1916 | Hill | 405/281 |
| 1,894,012 | 1/1933 | Wemlinger | 405/276 |
| 1,937,758 | 12/1933 | Harris | 405/279 |
| 2,054,203 | 9/1936 | Magee | 405/276 |
| 2,099,542 | 11/1937 | Stevens . | |

(List continued on next page.)

FOREIGN PATENT DOCUMENTS

| | | | |
|---|---|---|---|
| 0129275 | 12/1984 | European Pat. Off. . | |
| 0 186 921 | 7/1986 | European Pat. Off. . | |
| 0 286 068 | 10/1988 | European Pat. Off. . | |
| 742392 | 3/1933 | France | 405/277 |
| 760122 | 2/1934 | France . | |
| 1136728 | 5/1957 | France . | |
| 1460431 | 11/1966 | France . | |
| 2083998 | 12/1971 | France . | |

(List continued on next page.)

*Primary Examiner*—John A. Ricci
*Attorney, Agent, or Firm*—Anthony Asquith & Co.

[57] ABSTRACT

The barrier is waterproof, and is used to contain contaminated groundwater within an enclosure. Steel elements, are pile driven, the elements having rolled-over edge forms (5,6) which interengage. Upon interengagement, an enclosed hole (90) is created which extends from top to bottom of the piled elements. A scraper (19) on the junior element (8) cleans dirt out of the hole as the junior is driven down alongside the adjacent senior element (7). The hole may be cleaned out by inserting a hose pipe to the bottom of the hole (90) and flushing through with water. Then, a sealant is injected into the hole, using an injection tube in the hole. The interengagement of the edge forms (5,8) of the elements is such that the hole formed by the interengagement is constrained to its nominal size and shape throughout the whole height of the barrier.

15 Claims, 6 Drawing Sheets

U.S. PATENT DOCUMENTS

| | | | |
|---|---|---|---|
| 3,245,222 | 4/1966 | Galaup . | |
| 3,302,412 | 2/1967 | Hunsucker | 405/278 |
| 3,333,431 | 8/1967 | Dougherty | 405/278 |
| 3,646,766 | 3/1972 | Hilton et al. . | |
| 3,667,236 | 6/1972 | Rosene . | |
| 3,703,085 | 11/1972 | Wogerbauer . | |
| 4,027,488 | 6/1977 | Preradovich . | |
| 4,367,057 | 1/1983 | Hughes et al. | 405/267 |
| 4,453,366 | 6/1984 | Piccagli | 405/267 X |
| 4,484,835 | 11/1984 | van Klinken | 405/52 |
| 4,519,729 | 5/1985 | Clarke, Jr. et al. | 405/258 |
| 4,607,981 | 8/1986 | van Klinken | 405/52 |
| 4,671,705 | 6/1987 | Nussbaumer et al. | 405/267 |
| 4,673,316 | 6/1987 | Nussbaumer et al. | 405/267 |
| 4,741,644 | 5/1988 | Caballi et al. | 405/50 |
| 4,808,039 | 2/1989 | Fischer | 405/276 X |
| 4,877,357 | 10/1989 | Verstraeten | 405/267 |
| 4,981,540 | 1/1991 | Prochhorst | 405/278 X |
| 5,066,353 | 11/1991 | Bourdo | 156/300 |
| 5,106,233 | 4/1992 | Breaux | 405/128 |
| 5,782,583 | 7/1998 | Vales | 405/281 |

FOREIGN PATENT DOCUMENTS

| | | | |
|---|---|---|---|
| 446471 | 2/1925 | Germany . | |
| 657158 | 2/1938 | Germany . | |
| 2002799 | 2/1974 | Germany . | |
| 2714974 | 10/1978 | Germany . | |
| 2722978 | 11/1978 | Germany . | |
| 34 36 735 | 4/1986 | Germany . | |
| 56 12424 | 2/1981 | Japan . | |
| 56 111717 | 9/1981 | Japan . | |
| 131711 | 10/1981 | Japan . | |
| 56 131711 | 10/1981 | Japan . | |
| 57 205615 | 12/1982 | Japan . | |
| 58 189417 | 11/1983 | Japan . | |
| 61 158513 | 7/1986 | Japan . | |
| 280122 | 6/1988 | Japan . | |
| 1 280122 | 11/1989 | Japan . | |
| 8 300 596 | 9/1984 | Netherlands . | |
| 8 600 898 | 11/1987 | Netherlands . | |
| 168055 | 1/1933 | Switzerland . | |
| 208022 | 12/1923 | United Kingdom . | |
| 417773 | 10/1934 | United Kingdom | 405/278 |
| 417823 | 10/1934 | United Kingdom . | |
| 428398 | 5/1935 | United Kingdom . | |
| 518727 | 3/1940 | United Kingdom . | |
| 561765 | 6/1944 | United Kingdom . | |
| 640335 | 7/1950 | United Kingdom . | |
| 730835 | 6/1955 | United Kingdom | 405/279 |
| 1301320 | 12/1972 | United Kingdom . | |
| 1427060 | 3/1976 | United Kingdom . | |
| 1602597 | 11/1981 | United Kingdom . | |
| 2185901 | 8/1987 | United Kingdom . | |
| WO86/05532 | 9/1986 | WIPO . | |

IN-GROUND BARRIER

This application is a division of application Ser. No. 07/765,254, filed Sep. 25, 1991, now abandoned, which is a continuation of application Ser. No. 07/487,260, filed Mar. 2, 1990, now abandoned.

This invention relates to the provision of a barrier that comprises pile-driven elements.

BACKGROUND TO THE INVENTION

It is a well established practice to provide interlocking elements that may be pile-driven into the ground, for example along a river bank, to prevent the bank from crumbling, and collapsing into the river.

The elements of these conventional barriers comprise lengths of steel sheet material, the cross-sectional shape of which is produced by rolling the sheet between rollers. The cross-sectional shape of the element generally includes changes of plane, so that the element is resistant against buckling. The cross-sectional shape is generally also provided, along the edges of the element, with hook-like formations, whereby the element may interlock with adjacent elements.

Such barriers have not hitherto been waterproof, in that the hook-like formations have permitted a leakage flow of water to take place through the assembled barrier. Previous proposals for designing waterproof barriers are shown in EP-0129275 (CORTLEVER, Dec. 27, 1984; GB-1301320 (NEDERHORST, Dec. 29, 1972); and GB-0518727 (DALRYMPLE-HAY, Mar. 6, 1940). Other relevant publications from the art of pile-driven barriers include WO-86/05532 (PROPILAFROID, Sep. 25, 1986); GB-1427060 (SOLVAY, Mar. 3, 1976); GB-0640335 (WILLIAMSON, Jul. 19, 1950); and GB-0208022 (KOHLER, Dec. 13, 1923).

The above designs have not proved efficacious, primarily on the ground of reliability of the seal, and also cost. If a spill of a groundwater contaminant is made, and if it is determined that the spill must be contained behind a waterproof barrier, the expense can be enormous. Often, a barrier will comprise four plane walls, joined at the corners to make a rectangle, and thus the barrier will surround the zone of pollution, and fence it in. Sometimes, the barrier may not need to form a complete enclosure around the contaminant—where, for example, the requirement may simply be to divert a flow of polluted groundwater away from a well.

The invention is aimed at providing a barrier which can be rendered reliably waterproof in a less expensive manner than has been possible hitherto, from the standpoints both of materials cost and of installation cost, yet which is reliable and effective.

Apart from low cost, other aims of the invention are as follows: to reduce the disturbance of land during installation; to reduce shifting of the soil, which might be damaging to surrounding buildings; to reduce installation time; and to reduce the amount of heavy construction equipment needed.

It is recognized that it is not practicable to apply a sealing material to the element, prior to the element being driven into the ground. Even if the act of pile-driving the element does not actually damage the sealing material, the risk of such damage is high, and the engineer would not dare to take the chance since the cost of repairing a leaky barrier can be enormous. On the other hand, it has been perceived as very difficult to apply a sealant to the joints between elements once the elements have been driven into the ground.

BASIC FEATURES OF THE INVENTION

The elements of the barrier are provided with interlocking and inter-engaging edge forms. In the invention, these edge forms are so arranged that when the elements have been driven into place, the fact of the inter-engagement causes a hole to be created, being a hole that leads down from the ground surface to the bottom of the element. In the invention, the soil or other material that enters this hole when the elements are driven into the ground may be flushed out by means of a hose or pipe inserted into the hole, and the hole may then be filled with sealant material.

The edge forms are so arranged that, when sealant is injected into the hole, any potential leak paths running through the barrier from front to back are sealed off by means of the sealant. To this end, the design of the edge forms is such that the mouth of each leak path opens into the hole, so that sealant present in the hole may enter, and seal off, each leak path.

Consequently, the material that encircles the hole must come from both elements, ie: in the invention, the circumference of the hole cannot be formed entirely from the material of one element, but rather the two inter-engaging elements each must supply a portion of the material of the composite circumference of the hole.

It is recognized in the invention that the hole must remain the same shape and size during and after driving. If the hole were to close up, it would not be possible to insert the flush-out hose, nor to insert the sealant injection tube. Similarly, if the hole were to open out, either the hole might fill with soil, or the sealant might not be able to completely fill the hole.

A means is therefore provided for constraining the hole to a uniform size and shape. Preferably, the means is created simply by virtue of the manner in which the edge forms inter-engage, so that the means costs substantially nothing.

In the prior art, when a waterproof barrier has been needed, it has been known to excavate a trench, and to fill the trench with, for example, a soil-clay slurry. The sheet piling elements are driven down into and through this slurry, and the slurry then acts as the waterproof seal.

The invention is aimed at making it possible to achieve a corresponding reliability of watertightness, without the necessity for such measures as prior excavation. In the invention, the intention is that the piling elements may be reliably sealed, even though driven down into earth material that has not previously been excavated.

In the invention, the inter-engagement of the edge forms has the effect not only that the barrier may easily be rendered leakproof; it is recognized also that the barrier of the invention is just as readily usable in a barrier that has no need to be made leakproof. Furthermore, it is possible, with most embodiments of the barrier of the invention, to make a non-leakproof barrier leakproof at a later date, especially if precautions are taken to keep the holes open.

In the invention, the junior edge form is provided at its foot with a scraper. As stated, one portion of the composite circumference of the hole is formed by the senior edge form, and the remainder of the circumference is formed by the junior edge form: each edge form therefore itself does not form a complete enclosure, but must include a respective gap. In the invention, dirt and soil present inside the senior edge form, after driving, is deflected out of the gap in the senior edge form by the scraper at the foot of the junior edge form.

DETAILED DESCRIPTION OF PREFERRED EMBODIMENT

By way of further explanation of the invention, an exemplary embodiment of the invention will now be described with reference to the accompanying drawings, in which.

The barriers shown in the accompanying drawings and described below are merely examples. It should be noted that the scope of the invention is defined by the accompanying claims, and not necessarily by specific features of exemplary embodiments.

Figure 1:
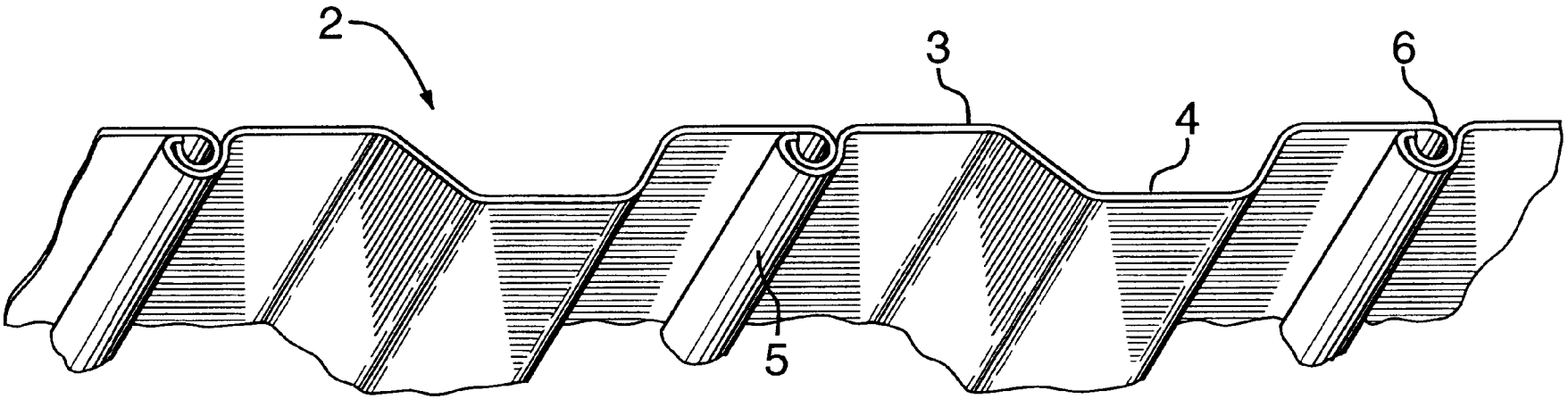
FIG. 1 shows a portion of a waterproof barrier which embodies the invention.

A barrier 2 comprises many sheet piling elements 3, some of which are shown in FIG. 1. Each element comprises a length of sheet steel of uniform cross-sectional shape. The conventional method by which such strips are manufactured is by a rolling operation, wherein the strips are passed between a series of rollers to produce the desired finished cross-sectional shape; and this conventional method may be employed also in the invention, to produce the required edge forms.

All the elements 3 have the same cross-section, which includes a central portion 4, in which the steel is somewhat angled to provide resistance to buckling while the element is being hammered into the ground, and to resist sideways distortion in the event that a pressure differential develops across the barrier.

The cross-section of the element also includes left and right edge forms 5,6.

Figure 2:
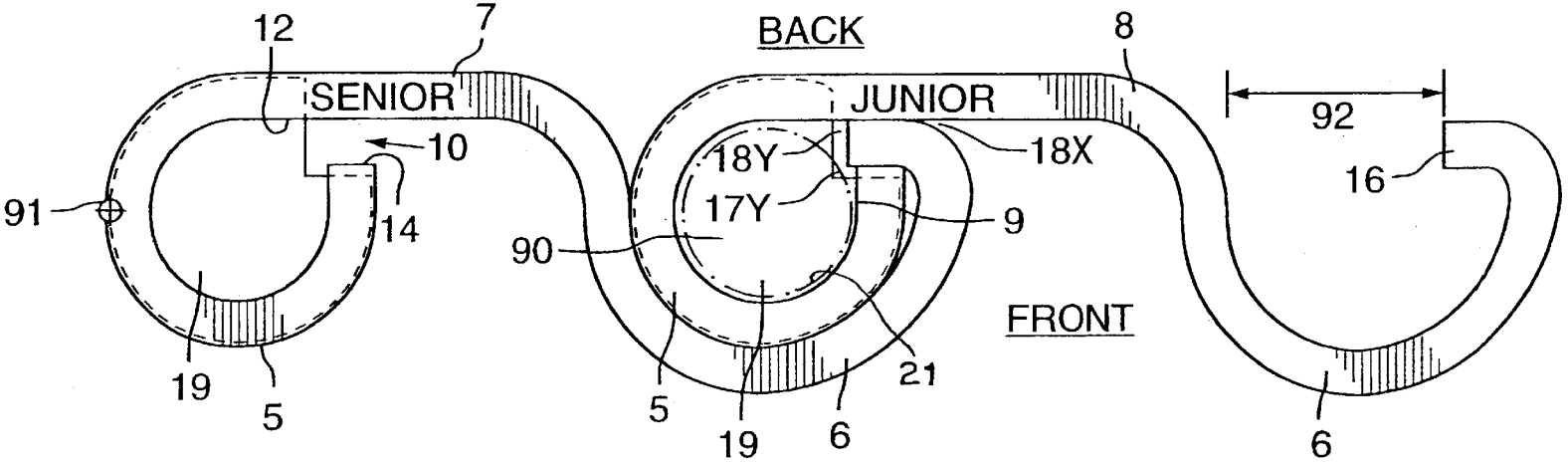
FIG. 2 is a plan view showing the interengagement of two elements of the barrier of FIG. 1.

FIG. 2 shows a close-up view of the left edge form 5 of a junior element 8 of the barrier, together with the right edge form 6 of a senior element 7 of the barrier. The left edge form 5 is such as to form almost a complete enclosure or encirclement. The left edge form 5 is not quite a complete enclosure however, in that a gap 10 is left between the end face 14 of the edge form 5, and the facing surface 12.

The gap 10 is filled, thus finally completing the encirclement 9, by a tag 16 provided as part of the right edge form 6. In fact, the gap 10 is smaller than the thickness of the material of the tag 16, so that the left edge form 5 tightly grips the tag 16 and thus the right edge form 6, during assembly of the elements, and afterwards.

As may be seen from FIG. 2, a potential leak path exists, by which fluid on the front side of the barrier might leak through to the back side of the barrier. This potential leak path may be regarded as divided into two components: a back leak path 17, having an entry mouth 17Y and an exit mouth 17X; and a front leak path 18, having an entry mouth 18Y and an exit mouth 18X. (The entry mouth of a leak path is that mouth of the leak path that opens into the enclosure.)

The entry mouths 17Y,18Y of the front and back leak paths 17,18 are spaced apart circumferentially around the enclosure 9. The distance of the spacing, as may be seen from FIG. 2, is equal to the thickness of the tag 16.

When installing the barrier, the elements are hammered downwards one after another, by a pile-driver. The senior and junior elements are so termed because the senior is driven in before the junior. In driving the piles of the invention, the conventional practice may be followed, of driving all the elements in the barrier in gradual progressive sequence, a little at a time.

When the senior element 7 has been fully driven, the space inside the right edge form 6 (which is to be occupied by the left edge form 5 of the junior element) would be now full of soil or gravel, and whatever other constituents are present in the ground, if precautions were not taken.

Figure 3:
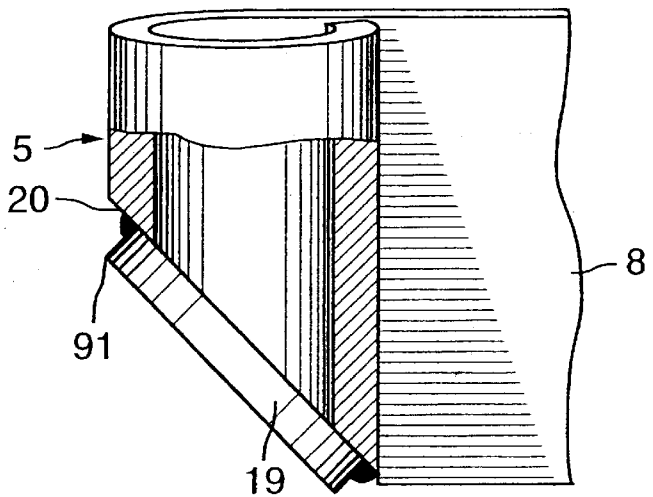
FIG. 3 is a side view of the foot of one of the elements shown in FIG. 2.

The left edge form of the junior element 8 is provided at its foot with a scraper 19, the purpose of which is to sweep the soil etc from the inside of the right edge form 6 of the senior element 7. FIG. 3 shows the foot of the left edge of the junior element 8. The left edge form 5 has been cut away at an angle, and the scraper 19 is welded in place onto the sloping face 20. The dot-dash lines in FIG. 2 indicate the outline of the scraper 19. (Similar dot-dash lines in the other drawings indicate corresponding scrapers.)

To install the barrier, the right edge form 6 of the senior element 7 is engaged with the left edge form 5 of the junior element 8, and driving commences. As the junior element 8 is driven downwards, the scraper 19 sweeps the soil out from inside the right edge form 6 of the senior element 7. The cleaned-out space thus created then is occupied by the left edge form 5 of the junior element 8.

When both the senior 7 and junior 8 elements have been installed, the circumference of the encirclement or enclosure 9 is complete, and the hole 90 inside the enclosure is substantially cleaned out.

The hole 90 is to be filled with a sealant. Before the sealant material can be inserted into the hole, the hole should be cleaned out. Accordingly, the next stage is that a hose or pipe is passed into the hole 90, and a jet of water is used to flush any remaining soil particles out of the hole. The hose or pipe should therefore be substantially smaller than the hole, to allow the dirt particles to travel past the hose, and out of the hole. The scraper 19 of course cannot be expected to sweep the space within the senior edge form 5 completely clean; but it is recognized that any particles not removed by the scraper will be small enough to be removed without trouble by the hosing operation.

The space within the hole, around the hose, should not be too large, because the particles are being removed by the upward velocity of the escaping water, and the particles might settle if that velocity were small.

When the hose has been passed right to the bottom of the hole 90, and when the water escaping from the top of the hole is running reasonably clean, the flushing operation is complete, and the hose may be removed from the hole, leaving the hole full of clear water. (It is sometimes advantageous to reverse the action of the hose, ie to pour water into the hole around the hose pipe, and to draw the water out of the hole up through the hose pipe.)

Next, a tube for the injection of sealant is inserted into the hole 90. When the tube has reached right to the bottom of the hole, sealant injection commences, and the tube is withdrawn progressively up the hole as the sealant fills the space below.

It is contemplated that the flushing hose and the injection tube might be inserted into the hole at the same time. Thus the sealant would be injected from the mouth of the injection tube: the mouth of the flushing hose would be above the mouth of the injection tube, and water would be flushed therefrom in such a manner as to keep the annulus around the tube clear, as the two are gradually drawn up to the surface.

The speed at which the sealant injection tube is withdrawn is important: if the tube is withdrawn too quickly, not enough sealant will be left in the hole, and the barrier may leak; if the tube is withdrawn too slowly, sealant may start to enter the space above the bottom of the injection tube, thus preventing the water in the hole from escaping, and perhaps trapping water bubbles within the sealant.

The kind of barrier with which the invention is concerned may be required to remain sealed for centuries, and it is important that the integrity of the seal is assured. Once sealant has been placed in the hole 90, it would generally be very difficult and expensive to replace it.

On the other hand, depending on the degree of security required, the nature of the contaminant, and other parameters, it may be preferred to use a sealant of the type that can be replaced, and to institute a policy of replacing the seal periodically.

The purpose of the sealant material is to fill the hole 90 within the enclosure 9, and then to penetrate and seal off the leak paths 17,18. At the time when it is penetrating the leak paths, the sealant needs to be under pressure, to force it into the tight, narrow, leak paths. To obtain the required pressure, the sealant material may be injected under pressure, or the sealant material may be of the kind that expands upon coming into contact with water.

Some sealant materials swell (slowly) when saturated with water: these are easy to inject properly, because the sealant material remains substantially loose in the hole for some time after the injection tube has been withdrawn. Later, the material swells, and penetrates the potential leak paths. One problem with the use of water-expanding materials is that there is not much water available in the hole 90.

Other materials expand immediately upon leaving the end of the injection tube, and these require much more care during injection.

Some sealant materials are in the form of two or more components, which, when mixed, produce a foam. These materials, though expensive, are useful in the invention, especially if the foaming reaction time can be delayed long enough for the injection tube to be out of the hole before foaming starts.

In selecting the type of sealant, the designer should assess the following aspects of performance: that the sealant is capable of penetrating into the potential leak paths; that the sealant will expand after emplacement; that the sealant has a low permeability to water; and usually that the sealant will bond readily to the steel of the pile elements.

The size of the hole 90 is important. First, the hole must be large enough to accept the flushing hose and the injection tube. Typically, the hose and tube will be of nominally half-inch (12.7 mm) internal diameter, such tubing being typically 18 mm outside diameter. The inscribed circle 21 (shown as a dotted line in FIG. 2) inside the hole 90 therefore should be at least 18 mm diameter, and preferably should be a margin of tolerance greater than that.

In fact, the size of the hole 90 should be larger still, to allow fluids inside the hole easily to flow upwards and out of the hole when the hose pipe is in place down the hole. Preferably, the cross-sectional area of the hole available for upward flow, ie the cross-sectional area of the hole minus the cross-sectional area occupied by the hose, should be at least as great as the cross-sectional area of the bore of the hose.

Thus, a half-inch bore has a cross-sectional area of 127 sq mm, and its outer diameter occupies a cross-sectional area of 255 sq mm. Therefore, the hole 90 should have a cross-sectional area of 382 sq mm, or more, if it is to properly accommodate a half-inch hose.

On the other hand, the cross-sectional area of the hole 90 should not be too large. If the hole were large in relation to the hose, water from the hose would flow only slowly up the hole, which might hinder the effectiveness of the flushing operation. Also, the larger the hole, the more (expensive) sealant is needed to fill it.

Thus, the preferred upper limit on the cross-sectional area of the hole would be around 450 or 500 sq mm, for a half-inch hose. The cross-sectional shape of the enclosure need not be circular, and a perusal of the drawings will show that the enclosure in fact is not circular.

When the hole has been correctly sized to accommodate the flushing hose, it may be found that the hole is rather too large for the pipe through which the sealant material is to be injected. In this case, sealant emerging from the bottom of the pipe could easily flow upwards, into the annulus surrounding the sealant injection pipe. To prevent this, and to allow the injected sealant to be placed under pressure, a collar may be fitted to the bottom of the injection pipe, which fills or almost fills the hole 90.

If the hose and tube were smaller than the half-inch size mentioned, the edge forms 5,6 of the elements would also have to be smaller, ie the edge forms would have to be bent into tighter shapes. The operation of rolling the material into tighter curves would not be so practicable, especially when the elements are of thicker steel.

The thicker materials are used in pile-driven barriers which have to be driven deeper, or which have to sustain large side-thrusts, for example when the barrier is used to prevent a river bank from collapsing. Pile-driven barriers have not generally been used for the purpose simply of sealing off an area of contaminated ground, where there is no real requirement for side-thrust capability. It may therefore be in some cases that the elements for a water-proof barrier may be of a thinner steel than has been required for conventional side-thrust-supporting barriers. In those cases, the edge forms may be bent to more intricate shapes, and smaller hoses and tubes may be used.

On the other hand again, the elements do have to be pile-driven into the ground, and the elements must be robust enough to stand up to the driving treatment. This aspect indicates that although a thinner element may be theoretically possible in some cases from the standpoint of supporting only light side-thrusts when installed, the thinner element cannot after all be permitted, because of the reduced drive-ability of the thin element, especially if the ground contains cobbles or other non-homogeneities that might interfere with the driving operation. In this case, insofar as hose size is dictated by the thickness, and hence the bend-ability, of the steel, it will probably be found that the dimensions adapted for half-inch hose once again would apply.

In other words, the flushing hose and injection tube will generally be of the half-inch size, for operational reasons, and it is recognized that the conventional range of thicknesses of steel from which pile-driven elements are made can be readily bent to the tightness required to accommodate the half-inch size. It is not an essential feature of the invention, however, that the hose be of the said nominal half-inch size.

It is important that the mechanical shape and size of the enclosure 9 be maintained accurately throughout the driving operation; and later, in service.

It may be noted from a perusal of FIG. 2 that the junior 8 and senior 7 elements are locked against movement relative to each other, both in the left/right sense, and in the front/back sense. It is important, in the invention, that this degree of constraint, even if the actual shapes of the edge forms are not those shown in FIG. 2, be always present. If the elements were allowed to move relative to each other during driving, such that the encirclement or enclosure 9 might become larger or smaller, the integrity of the seal between the elements could not be relied on.

When the edge forms are as shown at 5,6 in FIG. 2, the overlapping and interlocking interaction of the senior 7 and junior 8 elements, which leads to the creation of the encirclement or enclosure 9, also provides the required degree of guiding constraint between the elements to guarantee that the enclosure 9 remains always of the same shape and size.

Figure 4:
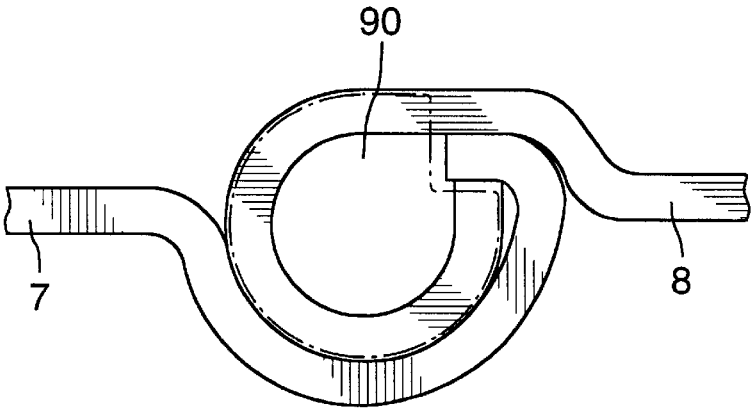
FIG. 4 is a plan view showing the interengagement of two elements of another barrier which embodies the invention.
Figure 5:
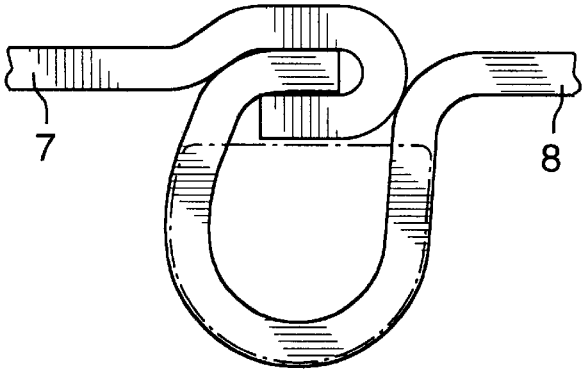
FIG. 5 is a plan view showing the interengagement of two elements of another barrier which embodies the invention.

The arrangement of FIG. 4 is an example of an arrangement that is equivalent to that of FIG. 2, for the purposes of the invention. The double bend, though more difficult to roll, adds worthwhile strength and robustness to the element.

However, it is not essential that the part of the interlocking structure that produces the guiding constraint, and the part of the interlocking structure that produces the enclosure, should be one and the same.

Figure 6:
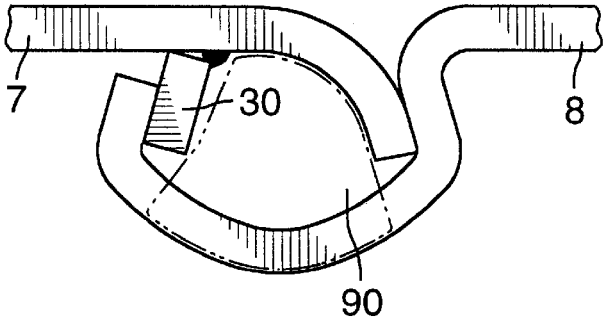
FIG. 6 is a plan view showing the interengagement of two elements of another barrier which embodies the invention.
Figure 7:
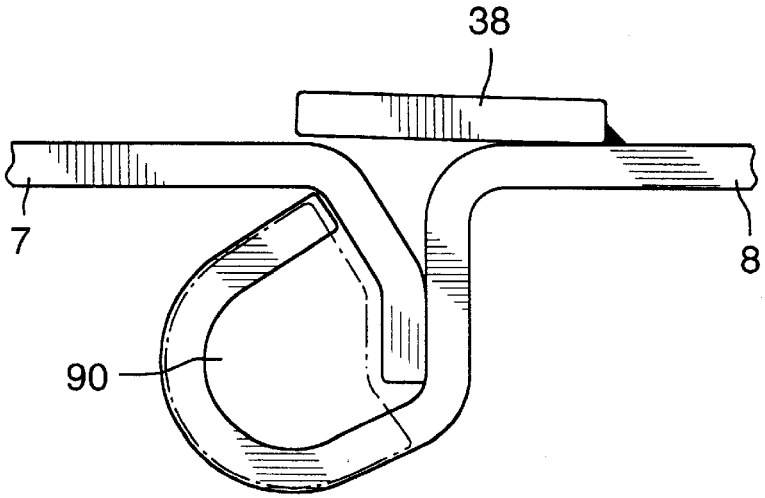
FIG. 7 is a plan view showing the interengagement of two elements of another barrier which embodies the invention.

The addition of a welded-on guide bar of course increases the cost of the element, but in some cases the extra expense may be more than recouped in the increased flexibility in the design of the enclosure. Ways in which a welded-on bar may be used are illustrated in FIGS. 6 and 7. The guide bar 30,38 need only be tacked onto the element at such intervals as will give adequate mechanical strength; the guide bar need not be itself sealed to the element.

Figure 8:
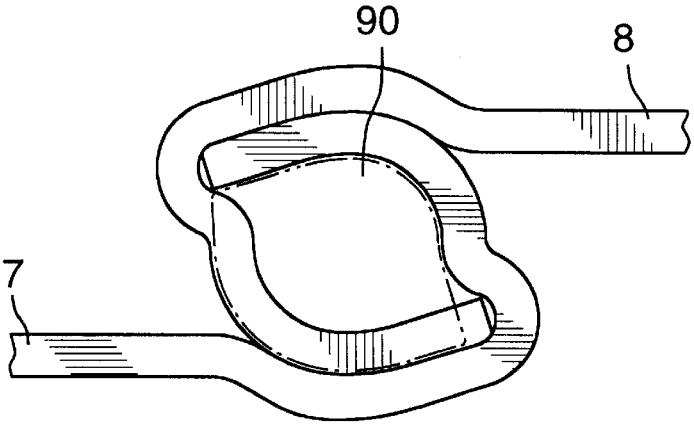
FIG. 8 is a plan view showing the interengagement of two elements of another barrier which embodies the invention.

When the edge forms of the elements are arranged as in FIG. 8, for example, the elements are so guided as to prevent relative movement in the front/back sense, and in the left/right sense. In FIG. 8, as indeed in the rest of the drawings (apart from FIG. 9), the elements cannot move relatively, neither so as to open the hole 90, nor so as to close the hole.

Figure 9:
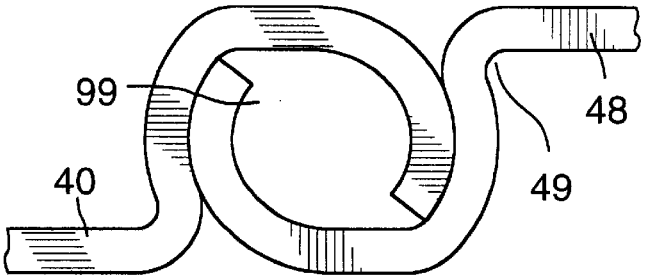
FIG. 9 is a plan view showing the interengagement of two elements of a barrier which does not embody the invention, but which is included for illustrative purposes.

In the example shown in FIG. 9, on the other hand, it will be noted that a mode of relative movement between the elements 40,48 has been permitted, which could lead to the hole 99 becoming smaller. Therefore, the arrangement of FIG. 9 is outside the invention.

Another problem with the FIG. 9 arrangement, apart from the fact that the elements are not properly guided relatively, lies in the fact that the edge form includes a re-entrant bend, at 49. Such a formation can make it difficult, during rolling, for the element to release from the rollers, and adds greatly to the expenses of manufacture. The tighter the bend 49, the more this problem arises.

Figure 10:
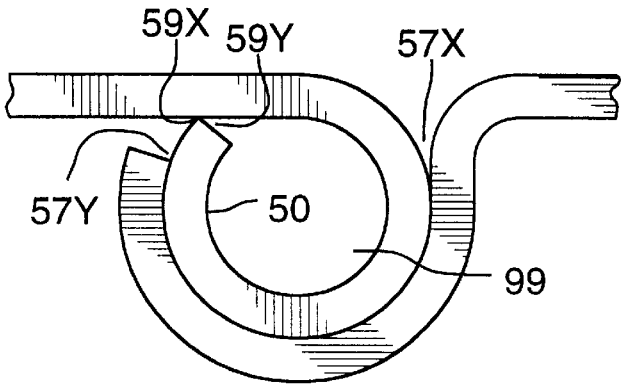
FIG. 10 is a plan view showing the interengagement of two elements of another barrier which does not embody the invention, but which is included for illustrative purposes.

It is recognized in the invention that the encirclement or enclosure should not be provided entirely in one of the elements, but instead the encirclement should not be complete until both elements are brought together. Thus the arrangement shown in FIG. 10 is outside the invention, because the encirclement 50 is, in substance, complete without the presence of the senior element 56. It will be observed that in FIG. 10 a leak path 57X,57Y exists, which does not communicate with the enclosure 50, and therefore this leak path will not be sealed by the sealant injected into the hole 99. In the invention, the mouths of both the back leak path and of the front leak path open into the enclosure, so that both leak paths are accessible to sealant inserted into the hole.

Figure 11:
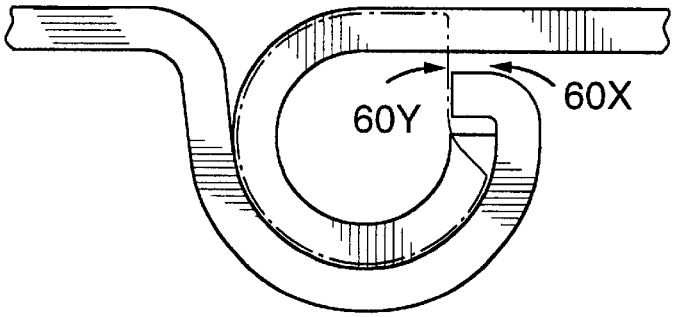
FIG. 11 is a plan view showing the interengagement of two elements of another barrier which embodies the invention.

In the arrangements described thus far, the leak paths have been the tight, narrow, tortuous paths that exist between two metal surfaces that are pressed together in directly contacting abutment. FIG. 11 shows an arrangement in which the front leak path 60X,60Y is wide open.

In the FIG. 11 example, when the sealant is injected into the hole, the sealant will tend to dissipate itself through this wide open leak path 60. However, depending on the nature of the surrounding soil, the amount of dissipation of the sealant into the soil may be acceptable, and thus the FIG. 11 example should be regarded as being within the broad scope of the invention.

Particularly in cases where the soil material is coherent, and therefore the soil tends to contain the sealant, and the soil does not tend to crumble in through any gaps, the potential leak paths need not be so tight. Generally, though, in the invention, it is preferred that the leak paths be not wide open, but that the metal interfaces at the leak path be pressed directly together, tightly and resiliently.

Figure 12:
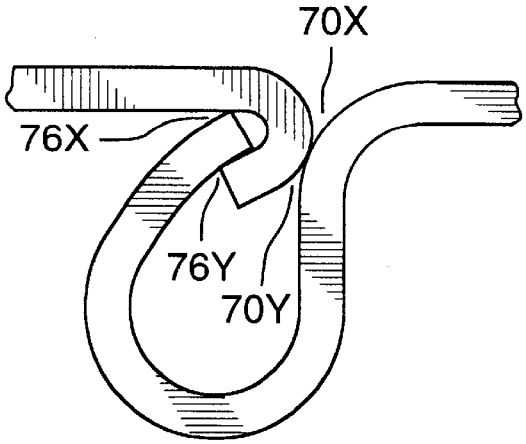
FIG. 12 is a plan view showing the interengagement of two elements of another barrier which embodies the invention.
Figure 13:
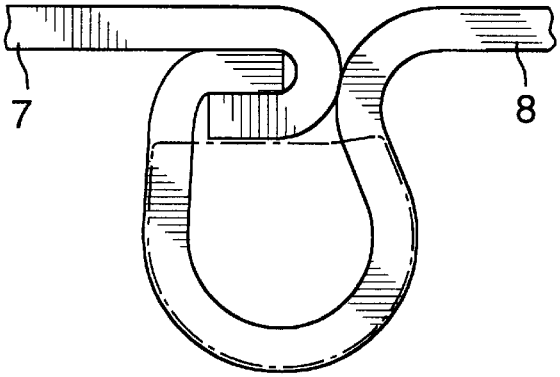
FIG. 13 is a plan view showing the interengagement of two elements of another barrier which embodies the invention.

It is also preferred that the metal surfaces at the interface be pressed together over a substantial length of engagement. In the arrangement of FIG. 12, for example, the metal surfaces only contact each other at a small point. The leak path 70X,70Y in that case is constituted by only a very short length of engagement, and it can happen that sealant might easily escape out through the gap, at any small flaw in the engaging surfaces. If that happens, a pressure might not develop in the sealant in the neighborhood of such a gap, and this lack of available pressure would marr the reliability of the penetration of the sealant into the other leak path 76X,76Y.

Therefore, in the invention, it is preferred as a general rule that the front and back leak paths should both be as tight, as long, and as resistant to the through-flow of sealant as possible, so that sealant pressure may be developed within the enclosure. The greater the pressure in the sealant, the greater the force available to squeeze the sealant into the nooks and crannies that inevitably exist at the interface between two pressed-together metal surfaces.

In many of the arrangements illustrated in the drawings, it does not matter which is the senior section, and which the junior. It should be noted that the scraper is attached to the junior section, and should be arranged so as to sweep out the soil etc that has accumulated inside the edge form of the senior element. In selecting which element is to be the senior, i.e. which element is to be driven first, it should be borne in mind that the opening in the edge form of the senior, through which the swept soil is to be ejected, should be wide open. It should also be noted that the scraper needs to be welded onto the bottom of the edge form over a substantial portion of the edge form, and not just over a small portion of the form.

In FIG. 2, for example, if the right element 8 were to be made the senior, and the left element 7 the junior (i.e. if the element 8 were to be driven in first) the scraper would have to be welded to the edge form 6. Therefore, the scraper would have to be welded to the tag 16, since the tag 16 is the only portion of the now-junior edge form 6 that has access to the inside of the now-senior edge form 5. Equally, in that case, the soil etc. contained inside the edge form 6 would have to be swept out through the relatively narrow space of the gap 10. Thus it is important in FIG. 2 that the senior/Junior choice be as first described.

In the arrangement of e.g. FIG. 8, on the other hand, it makes little difference which element is the senior and which the junior. It is essential, though, that the scraper be attached to whichever of the edge forms is selected as the junior.

In the invention, as mentioned, it is essential that an enclosure or encirclement be created by the inter-engagement of adjoining elements; and it is essential that all potential leak paths from the front to the back of the barrier should communicate with this enclosure, so that, when sealant is injected into the enclosure, the sealant seals off the leak paths.

It is also essential that the elements be provided with a mechanical guiding and locating means whereby the adjoining elements are prevented from encroaching or separating with respect to each other. This ensures that the enclosures are maintained dimensionally constant over the whole engaged height of the elements.

However, whilst it is essential that a mechanical guiding and location means be provided, it is not essential that the bent and folded components of the edge formations should necessarily be the sole constituents of that means.

Figure 16:
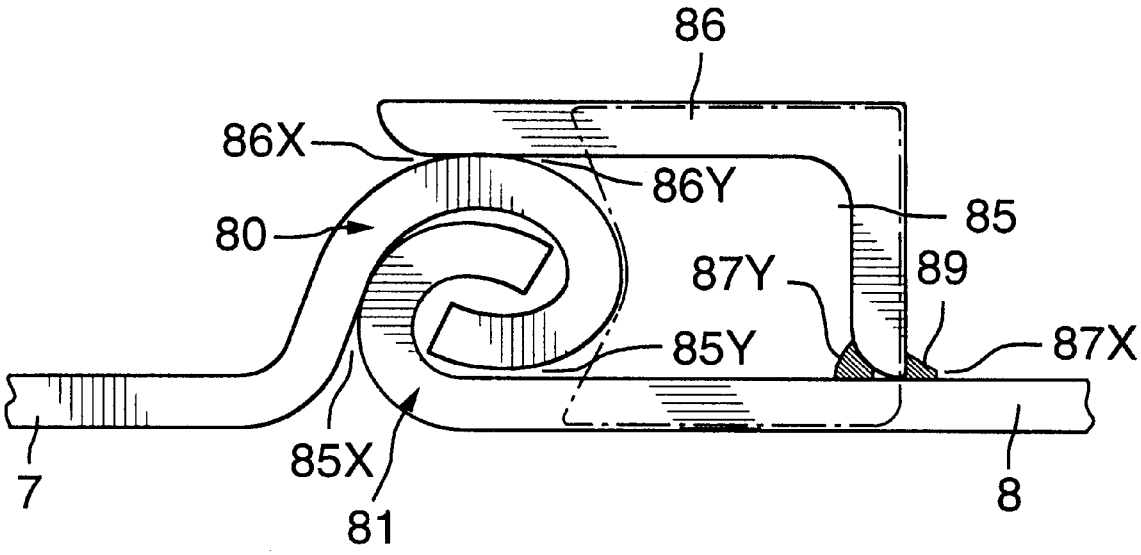
FIG. 16 is a plan view showing the interengagement of two elements of another barrier which embodies the invention.

FIG. 16 shows an arrangement wherein the rolled and bent edge forms 80,81 are simply hooks, which, when engaged together, serve to guide and locate the elements by preventing the elements 7,8 from encroaching or separating with respect to each other. The encirclement or enclosure 83, as required in the invention, in this case is completed by an added-on L-shaped steel section 84, which is welded to the element 8.

In FIG. 16, the front leak path 85X,85Y is the tortuous path between the two hook shapes. There are two potential back leak paths, designated 86X,86Y and 87X,87Y. (The welding indicated at 89 is not continuous but is just tacked at intervals.) Sealant injected into the enclosure 83 is able to seal off all the potential leak paths, however.

Figure 17:
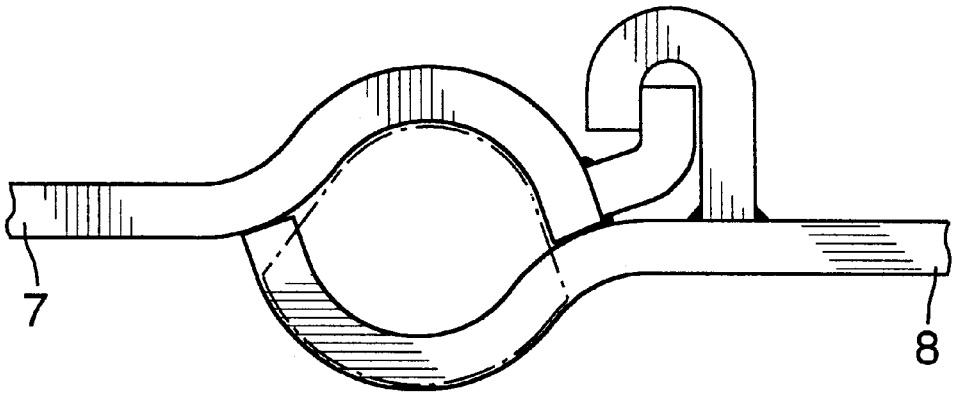
FIG. 17 is a plan view showing the interengagement of two elements of another barrier which embodies the invention.

In FIG. 16, the rolled and bent edge formations only comprise the mechanical guide means, not the enclosure. In FIG. 17, by contrast, the rolled and bent over edges comprise only the enclosure, not the mechanical guide means.

Figure 14:
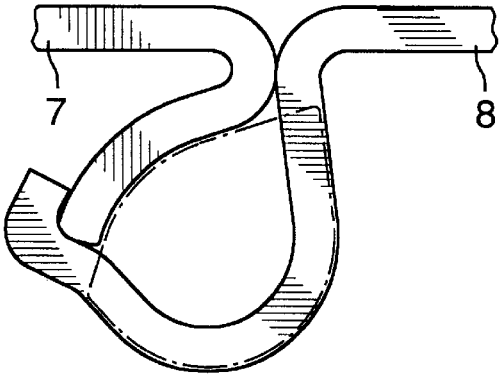
FIG. 14 is a plan view showing the interengagement of two elements of another barrier which embodies the invention.
Figure 15:
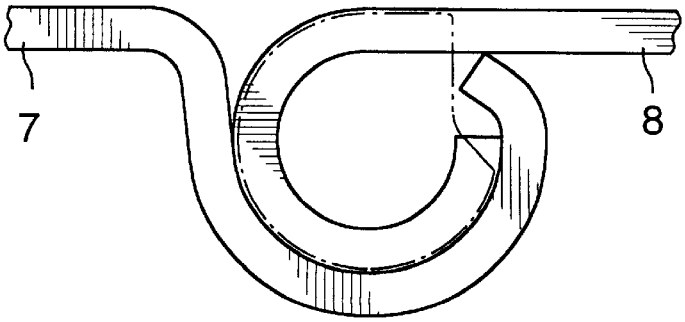
FIG. 15 is a plan view showing the interengagement of two elements of another barrier which embodies the invention.

In some barriers, it can be important that articulation of the elements can take place, for example when the containment zone created by the barrier has to follow a curved outline. Some of the embodiments shown in the drawings do not permit such articulation; FIG. 14, for example. In FIG. 12, on the other hand, several degrees of articulation movement could be accommodated, without the dimensions and shape of the enclosure becoming distorted. The manner in which the elements engage must be such that even if articulation does take place, the size and shape of the enclosure are not substantially affected thereby.

To lessen the resistance to articulation, the inter-engaging hooks, and other shapes as described, may be provided with more clearance or looseness than that indicated in the drawings.

The drawings (including those not specifically referred to) are presented so as to show many examples of shapes of the edge forms that may be employed in accordance with the invention. Some general principles may be noted in relation to the examples.

It is preferable that the senior edge form should have a large gap in its circumference, i.e. that the senior edge form should not constitute so much of the circumference of the final enclosure as to prevent the dirt from escaping. Any dirt swept out of the senior, by the scraper attached to the junior, passes out through whatever circumferential gap is present in the senior. It is preferable therefore that the circumference of the hole 90 should be constituted not almost wholly by the senior but that a substantial portion of the circumference of the hole should be constituted by the junior.

As regards the angle at which the scraper is set, it is important that the foot of the element should not be cut off at such an angle that corners of the web might be left that would be exposed and vulnerable to damage during piling. In FIG. 3, the slope of the cut is from left to right: the slope should not be from right to left in that view. The angle at which the scraper is set preferably should be such that the top of the scraper lies towards the centre of the circumferential gap in the senior, i.e. the gap through which the ejected dirt is to pass.

As may be seen from FIG. 3, the topmost point of the scraper is that marked 91 in FIG. 2, towards the extreme left of the edge form 5; the gap 92 in the right edge form 6, through which the scraped out dirt is to escape, however, faces the back (top in FIG. 2) of the barrier. It would be preferable if the topmost point 91 of the scraper were to be aligned exactly with the gap 92; but it is recognized that in fact exact alignment is not required. The topmost point on the scraper should not, however, be so far out of alignment as to be, for example, diametricaly opposite the gap.

The scraper is of course vulnerable to being damaged during driving, being at the foot of the element. Therefore the scraper should be attached to the edge form 5 over as much of its circumference as possible. Thus in FIG. 2 the scraper is welded over at least ¾ of its circumference, which is very strong. The scrapers in FIGS. 4,5,7,11,12,13,15,16 are also good from this standpoint. The scrapers in FIGS. 6,8,14 are, however, less robustly attached.

It will generally always be preferable to have the topmost point on the scraper towards the left of the left edge form (with the left/right orientation as shown in the drawings). The angle of the cut-off or chamfer plane 20 as is shown in FIG. 3 is convenient to manufacture and leaves no vulnerable exposed ends which might be bent aside during driving. The restriction should be borne in mind, though, that if the topmost point of the scraper is at its extreme left, the gap in the senior edge form should not face directly towards the right. In almost all the drawings the gap in the senior edge form faces, at least to some extent, to the left. Only in FIG. 16 does the gap in the senior edge form face to the right; but in FIG. 16 the gap is so wide—being in fact approximately ¾ of the total circumference of the enclosure—that there will be little problem of the scraped dirt being deflected aside, whatever the angle of the scraper.

Another aspect to be considered in the layout of the edge forms is that of the circumferential length of each of the elements that is exposed to the sealant. Preferably, each element should have a long length exposed to the sealant, so that the sealant has a good opportunity to adhere to both elements.

In the case where the barrier is to fully encircle a contaminated area of ground, the final element of the barrier to be driven will have to engage with the edge forms of two other elements. It is an advantage in that case if the layout of the edge forms be chosen from the standpoint that the senior/junior roles be interchangeable.

It will be appreciated that an element is either senior or junior only in relation to its neighbours. In FIG. 2 the element 8 is junior to the element 7, but in turn the element 8 will be senior to the element (not shown) that will be placed immediately to its right. When the barrier forms a complete periphery, the last-inserted element will be junior to its adjacent neighbours both to the left and to the right.

It may be preferable in some barriers for the main elements of the barrier to be of thicker steel, and for these main elements to be joined by coupling elements of thinner steel. The thinner material can be more easily rolled to tightly-radiused shapes.

In some cases, it may be preferred that the barriers include a sharp bend. In that case, a piling element may be bent about a vertical axis, at the appropriate angle, for use at the bend. A rectangular encirclement may be achieved, for example, by setting four such elements, each with a right-angle bend, at the four corners.

It may be noted that the barrier of the invention, although designed for use as a sealable barrier, in fact may be used as an ordinary unsealed barrier, simply by omitting to inject sealant into the hole 90. The enclosure is created simply by virtue of the shape in which the edge forms are rolled, and once the rollers exist for manufacturing those edge forms, the forms can be used universally. If the barrier is not sealed, i.e. if sealant is not injected into the holes 90 (as a matter of policy at the time of installing the barrier) the holes 90 preferably should be protected. This can be done by plugging the tops of the holes. Then, the option is available to change the policy later, to remove the plugs and to inject sealant.

In this specification, the terms "right" and "left" are used interchangeably, and are for definition purposes only. The terms, as used herein with reference to the edge-forms of the pile-driven elements of the barrier, should not be construed as being limited only to a particular manner of viewing the barrier. Thus, if a particular barrier is viewed first from the front, and then the same barrier is viewed from the rear, what was first a left edge-form becomes a right edge-form, and vice versa. In construing the scope of the accompanying claims, it is arbitrary whether the barrier is viewed from the front or from the back: but the manner of viewing the barrier should be consistent, either consistently from the back or consistently from the front.

What is claimed is:

1. Sealable barrier, suitable for in-ground use, wherein:

the barrier includes adjoining barrier elements, each element comprising a length of sheet metal having a cross-sectional shape when viewed in plan, the elements being arranged edge to edge;

the elements are adapted to be installed in the ground by being driven into the ground in sequence, a senior one of the elements being driven ahead of an adjoining one of the elements, termed a junior one of the elements;

the cross-sectional shape of each element is provided with a left edge-form and a right edge-form;

when the barrier is installed in the ground, the right edge-form of the senior element is in operative engagement with the left edge-form of the adjoining junior element;

the said operatively engaging left and right edge-forms overlap and interlock together to form, when viewed in plan, the circumference of an enclosure;

one portion, termed the senior portion, of the circumference of the enclosure, being less than the whole circumference of the enclosure is constituted by a portion of the right edge-form of the senior element, and another portion of the circumference of the enclosure, termed the junior portion, being also less than the whole circumference of the enclosure is constituted by a portion of the left edge-form of the junior element;

whereby the circumference of the enclosure is inherently not watertight, in that potential leakage paths exist between the senior and junior portions of the circumference of the enclosure;

the senior and junior portions of the circumference of the enclosure overlap and interlock in such a manner that each and every leakage path starting from in front of the barrier and finishing behind the barrier is in communication with the said enclosure;

the cross-sectional shape and size of the said enclosure, when viewed in plan, is such that a circle inscribed within the enclosure is of a substantial diameter;

the inscribed circle is clear and unobstructed, in that none of the metal of either element encroaches within the said inscribed circle;

the barrier includes a means for maintaining uniform the size and shape, when viewed in plan, of the said enclosure, both during driving and after;

the barrier includes a scraper; the scraper is attached to the metal of the junior element, and is attached at or adjacent to the foot of the left edge form of the junior element;

the scraper is of such shape and dimensions as to occupy, substantially fully, when viewed in plan, the cross-sectional shape of the said enclosure;

the said inscribed circle within the enclosure is clear and unobstructed over the height of the barrier, from the ground surface down to the scraper;

the said inscribed circle within the enclosure is clear and unobstructed to the extent that, when the barrier is installed in the ground, a hose or tube can be inserted into, and passed down, the enclosure from the ground surface to the scraper.

2. Barrier of claim 1, wherein the said edge forms are formed entirely by rolling and bending the sheet metal comprising the elements.

3. Barrier of claim 1, wherein the junior portion of the circumference of the enclosure occupies at least ¾ of the whole circumference of the enclosure.

4. Barrier of claim 3, wherein the scraper is welded firmly to the foot of the right edge form of the junior element over substantially the full extent of the junior portion of the circumference of the enclosure.

5. Barrier of claim 1, wherein the scraper is placed at such an angle, at the foot of the left edge form of the junior element, that the topmost point of the scraper lies towards the extreme left of the said left edge form.

6. Barrier of claim 1, wherein the cross-sectional area of the enclosure is approximately 382 sq mm.

7. Barrier of claim 1, wherein the size and shape of the said enclosure at any point of the height of the barrier is identical to the size and shape of that enclosure at any other point of the height of the barrier.

8. Barrier of claim 1, wherein:

the barrier includes means for urging the said senior and junior portions of the circumference of the enclosure into resilient abutment;

the said leakage paths comprise crannies between the abutting metal surfaces;

and the circumference of the enclosure is complete in that no leakage paths are present which are more open than the said crannies to the passage of a fluid out of the enclosure.

9. Procedure for making an in-ground barrier, wherein:

the procedure includes the step of providing adjoining barrier elements, each element comprising a length of sheet material of uniform cross-sectional shape when viewed in plan, the elements being arranged edge to edge;

the procedure includes the step of inserting the elements into the ground;

the cross-sectional shape of each element, when viewed in plan, has a left edge-form and a right edge-form;

the barrier is of the type wherein, when the barrier is installed in the ground, the right edge-form of a senior element is in operative engagement with the left edge-form of the adjoining junior element;

the said operatively engaging left and right edge-forms overlap and interlock together to form, when viewed in plan, the circumference of an enclosure, which defines a cavity;

one portion, termed the senior portion, of the circumference of the enclosure, being less than the whole circumference of the enclosure is constituted by a portion of the right edge-form of the senior element, and another portion of the circumference of the enclosure, termed the junior portion, being also less than the whole circumference of the enclosure is constituted by a portion of the left edge-form of the junior element;

whereby the circumference of the enclosure is inherently not watertight, in that potential leakage paths exist between the senior and junior portions of the circumference of the enclosure;

the senior and junior portions of the circumference of the enclosure overlap and interlock in such a manner that each and every leakage path starting from in front of the barrier and finishing behind the barrier is in communication with the said cavity;

the shape and size of the said enclosure, when viewed in plan, is such that a circle inscribed within the cavity has a substantial diameter;

the said inscribed circle is clear and unobstructed, in that, when viewed in plan, none of the material of either element encroaches within the inscribed circle;

the edge-forms of the elements are so shaped that the said inscribed circle within the enclosure is clear and unobstructed over the height of the enclosure;

the said senior and junior elements are provided with a mutually-interlocking dovetail means, for maintaining uniform the size and shape, when viewed in plan, of the said enclosure, both during insertion and after;

the procedure includes the step of extracting solid material from the cavity inside the enclosure, and of removing the said solid material from the cavity;

the procedure includes extracting and removing the solid material to the extent that, after removal, the cavity is substantially unobstructed by solid material, and is substantially clear and open, over the whole height of the enclosure, from top to bottom of the barrier.

10. Procedure of claim 9, wherein an upper end of the enclosure comprises an open mouth, located above the ground surface, and wherein the manner of removing the solid material from the cavity is such that, during removal of the solid material, the solid material passes out through the said open mouth.

11. Procedure of claim 9, wherein the insertion of the elements into the ground is effected by pile-driving the elements directly into the ground.

12. Procedure of claim 9, wherein the solid material is extracted and removed by flushing out the enclosure, wherein the procedure includes the step of inserting a hose down into the enclosure from the ground surface, and of injecting flushing liquid into and through the enclosure via the hose;

wherein the hose is of substantially less cross-sectional area than the cross-sectional area of the enclosure;

and the procedure includes the step of continuing to inject the flushing liquid until the liquid emerges at the ground surface, and until the emerging liquid runs substantially clear.

13. Procedure of claim 12, wherein the cross-sectional area of the hose is about equal to the cross-sectional area of the cavity remaining outside the hose when the hose is present in the cavity.

14. A set of elements of sheet metal, the elements being suitable for installation in the ground by pile-driving down from the ground surface, and being assemblable together edge-to-edge to form an in-ground barrier;

each element comprises a length of sheet metal of uniform cross-sectional shape when viewed in plan;

the cross-sectional shape of each element, when viewed in plan, has a left edge-form and a right edge-form;

the left edge-form of one of the elements is operatively engageable with the right edge-form of an adjoining one of the elements;

the left and right edge-forms are so shaped that, when engaged, the edge forms interlock together to form, when viewed in plan, the circumference of an enclosure, which defines a cavity, the enclosure and the cavity having the following characteristics;

one portion, termed the senior portion, of the circumference of the enclosure, being less than the whole circumference of the enclosure is constituted by a portion of the right edge-form of the senior element, and another portion of the circumference of the enclosure, termed the junior portion, being also less than the whole circumference of the enclosure is constituted by a portion of the left edge-form of the junior element;

whereby the circumference of the enclosure is inherently not watertight, in that potential leakage paths exist between the senior and junior portions of the circumference of the enclosure;

the senior and junior portions of the circumference of the enclosure overlap and interlock in such a manner that each and every leakage path starting from in front of the barrier and finishing behind the barrier is in communication with the said cavity;

the shape and size of the said enclosure, when viewed in plan, is such that a circle inscribed within the cavity has a substantial diameter;

and the said inscribed circle is clear and unobstructed, in that, when viewed in plan, none of the material of either element encroaches within the inscribed circle;

each element is provided with a dovetail means, which, when the element is engaged edge to edge with an adjacent element, comprises a means for maintaining uniform the size and shape, when viewed in plan, of the said enclosure, both during insertion and after;

each element includes a respective scraper;

the scraper is attached to the metal of the respective element, and is attached at or adjacent to the foot of the left edge form thereof;

the scraper is of such shape and dimensions as to occupy, substantially fully, when viewed in plan, the cross-sectional shape of the enclosure;

and the edge-forms of the elements are so shaped that the said inscribed circle within the enclosure is clear and unobstructed over the height of the enclosure, to the extent that, when the barrier is installed in the ground, a hose or tube can be inserted into, and passed down, the enclosure from the ground surface to the scraper.

15. Barrier of claim 14, wherein the substantial diameter is at least 18 mm.

* * * * *